United States Patent [19]

Gordon

[11] 3,945,414

[45] Mar. 23, 1976

[54] APPARATUS FOR DEFLECTING A NAIL INTO AN ARCUATE PATH

[76] Inventor: Dean R. Gordon, 5153 N. 29th Ave., Phoenix, Ariz. 85017

[22] Filed: Mar. 27, 1975

[21] Appl. No.: 562,501

[52] U.S. Cl. ..... 145/46; 227/83

[51] Int. Cl.[2] ..... B25C 3/00

[58] Field of Search ..... 227/83; 145/46

[56] References Cited

UNITED STATES PATENTS

| | | | |
|---|---|---|---|
| 337,905 | 3/1886 | Wheelock | 145/46 |
| 1,542,946 | 6/1925 | Lawson | 227/83 |
| 1,570,686 | 1/1926 | Lawson | 227/83 |
| 2,234,448 | 3/1941 | Posnack | 227/83 X |

FOREIGN PATENTS OR APPLICATIONS

| | | | |
|---|---|---|---|
| 221,265 | 5/1962 | Austria | 145/46 |
| 390,385 | 2/1924 | Germany | 145/46 |

*Primary Examiner*—Granville Y. Custer, Jr.
*Attorney, Agent, or Firm*—Herbert E. Haynes, Jr.

[57] ABSTRACT

An apparatus for deflecting a driven nail into an arcuate path including a guide body which supportingly guides movements of the nail into engagement with a deflection means which bends the shank of the nail into an arcuate configuration of predetermined curvature. The apparatus also includes a disengagement device which is employed for removing the apparatus from nails having heads thereon.

9 Claims, 12 Drawing Figures

APPARATUS FOR DEFLECTING A NAIL INTO AN ARCUATE PATH

BACKGROUND OF THE INVENTION

1. Field of the Invention

This invention relates to the art of mechanical fasteners and more particularly to an apparatus for deflecting a driven nail into an arcuate path.

2. Description of the Prior Art

In the construction arts, the well known conventional way of driving a nail perpendicularly to the planar surface of a structural member to join another member thereto is commonly employed and used in most instances. However, many situations occur which make it impossible, or at least undesirable, to drive a nail in the conventional manner. One example of such a situation is when the rafters of a roof structure are joined to a wall plate. In such instances toenailing, i.e., driving a nail diagonally or obliquely, is employed to join such structural members. The inevitable surface marking of materials which have been joined by toenailing make it undesirable to use that technique in locations which will be exposed when the structure is completed. Another drawback of the toenailing technique is that it is virtually impossible for a structural engineer to calculate the holding power of a nail driven in accordance with that technique due to various angular relationships, material density, and the like. For this reason, the building codes of many municipalities will sanction toenailing only as a last resort and some codes require that anchor straps of metal be used instead of or in conjunction with, toenailing.

Another example where conventional nailing practices are undesirable is in the fabrication of finished wooden assemblies such as cabinets, prefabricated door jambs, and the like. Such structures are nailed or stapled whenever possible so that the nail heads won't show in the finished assembly due to the need for filling the resulting holes. In many instances nailing from areas that won't be exposed is either impossible or results in assemblies that are structurally inadequate.

Prefabricated panels such as wall panels, roof panels, and the like are usually prefabricated only to the extent that the frames thereof are prefabricated. After the prefabricated frames are installed, the finishing materials such as wallboards, roof sheeting, and the like are affixed to the installed frames. The reason for not completely prefabricating such panels into closed units, is that it is virtually impossible to nail a closed panel to an abutting panel or to a wall plate without damaging the finishing material of the panel.

Therefore, a need exists for a new and useful apparatus for deflecting a nail into an arcuate path, with such an apparatus overcoming some of the limitations and drawbacks of the prior art nailing techniques.

SUMMARY OF THE INVENTION

In accordance with the present invention, a new and useful apparatus for deflecting a nail into an arcuate path is disclosed with that apparatus including a guide body into which a nail is driven. The guide body provides support for the nail and guides its movements into engagement with a deflecting means which bends the shank of the nail into an arcuate configuration having a predetermined curvature.

When headless nails are employed, those nails may be completely driven through the apparatus of the present invention, or the apparatus may simply be lifted off of a partially driven headless nail. However, nails having heads cannot be completely driven through the instant apparatus, nor can that apparatus be lifted therefrom. Therefore, the apparatus of the present invention also includes disengagement means which allows removal of the apparatus from partially driven nails having heads thereon.

By driving a nail in an arcuate path with the apparatus of the present invention, the prior art technique of toenailing can be completely eliminated as such an arcuately driven nail will not inherently result in surface marking of structural members, will have superior holding power, and that holding power can be more easily calculated. Further, arcuately driven nails can be employed to install completely prefabricated closed panels, and can be used on finished assemblies with the result being increased structural strength, little or no surface marking, and the like.

Accordingly, it is an object of the present invention to provide a new and useful apparatus for deflecting a nail into an arcuate path.

Another object of the present invention is to provide a new and useful apparatus for driving a nail in an arcuate path and directing that arcuately configured nail into a workpiece.

Another object of the present invention is to provide a new and useful apparatus including a guide body which supportingly guides a driven nail into engagement with a deflecting means which bends the shank of the nail into an arcuate configuration.

Another object of the present invention is to provide a new and useful apparatus which includes a guide body that supportingly guides a driven nail into engagement with a deflecting means which bends the shank of the nail into an arcuate configuration, with that apparatus including disengagement means for removal of the apparatus from a partially driven nail having a head thereon.

Still another object of the present invention is to provide a new and useful apparatus of the above described character in which nails can be driven with a conventional hammer or the apparatus can be employed with suitable power nailing equipment.

The foregoing and other objects of the present invention as well as the invention itself may be more fully understood from the following description when read in conjunction with the accompanying drawings.

DESCRIPTION OF THE PREFERRED EMBODIMENTS

Figure 1:
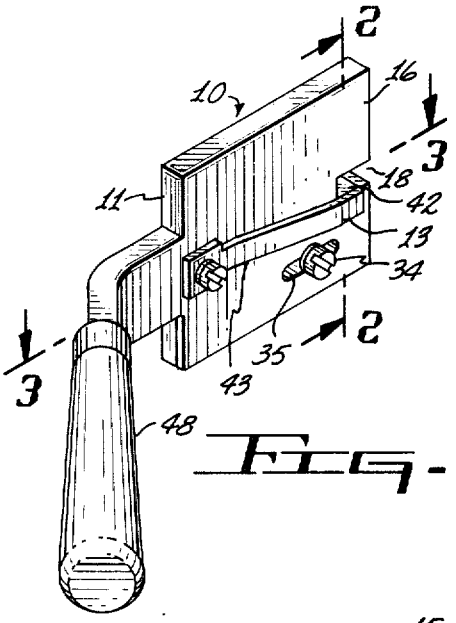
FIG. 1 is an isometric view of a first embodiment of the present invention.

Referring more particularly to the drawings, FIGS. 1–7 illustrate the first embodiment of the apparatus for deflecting a nail into an arcuate path which is indicated generally by the reference numeral 10. As shown, the apparatus 10 includes a guide means or body 11, a deflection means 12, and a disengaging means 13. The guide means 11 and the deflection means 12 cooperate to supportingly guide the movements of a nail 14 and deflect the shank 15 thereof into an arcuate path as will hereinafter be described in detail.

The guide body 11 is shown as a flat plate 16 having a passage or slot 18 formed therethrough. The slot 18 is disposed to extend inwardly from one edge of the flat plate 16 and to extend between the opposite planar surfaces of the plate 16. The slot 18 is adapted to receive the shank 15 of the nail 14 and supportingly guide the movements of the nail from the inlet side 19 to the outlet side 10 of the slot 18 and into engagement with the deflection means 12.

The deflection means 12 includes a block 22 which is mounted on the outlet side of the plate 16 adjacent the outlet opening 20 of the slot 18. The block 22 is provided with an inclined suface 24 for deflectingly engaging the shank 15 of the nail 14 as it emerges from the slot 18. In order to accomplish the deflection of the shank 15, the block 22 is positioned so that the inclined surface 24 thereof projects over the outlet opening 20 of the slot 18 and is spaced outwardly therefrom.

Figure 2:
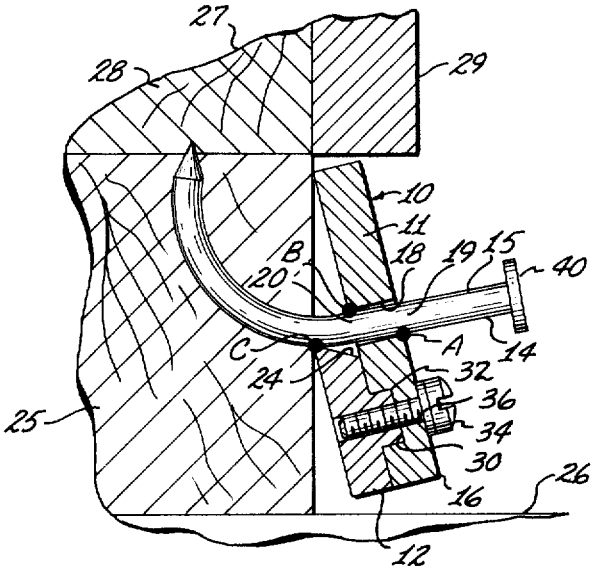
FIG. 2 is an enlarged sectional view taken on the line 2—2 of FIG. 1 and illustrating the apparatus of the present invention in a typical use thereof.

Reference is now made to FIG. 2 wherein the apparatus 10 is shown in a typical working environment which will now be described in conjunction with the apparatus 10 to facilitate understanding of the operation of the apparatus.

The typical working environment shown in FIG. 2 includes a wall plate 25 which is suitably secured to the floor 26 as is customary in the art. Positioned atop the wall plate 25 is a prefabricated closed wall panel 27 which includes a frame member 28 and suitable finishing material 29 such as a wallboard, wood paneling, and the like. To secure the closed wall panel 27 to the wall plate 25, the apparatus 10 is placed adjacent the wall plate 25 and the nail 14 is driven into the slot 18 of th guide body 11. When the shank 15 of the nail 14 is driven into engagement with the inclined surface 24 of the deflection means 12, the nail 14 will be moved so as to become angularly oriented within the slot 18. The angular orienting, or cocking, of the nail 14 will move the shank 15 thereof into engagement with point A located at the inlet opening 19 of the slot 18 and the diametrically opposed side of the shank 15 will move into engagement with point B located at the outlet opening 20 of the slot 18. These points A and B serve as support points against which the shank 15 of the nail bears during deflection thereof. The point C on the inclined surface 24 of the deflection means 12 is the point of engagement of the shank 15 of the nail 14 and will cause deflection of the shank into an arcuate path. Thus, as the nail is driven into engagement with point C, the shank 15 of the nail 14 will be deflected and will enter into the wall plate 25. After penetrating into the side of the wall plate 25, the deflected arcuate configuration of the shank of the nail will cause it to move in a curved path and emerge from the top of the wall plate 25 and penetrate into the bottom of the frame member 28. The movement of the nail in the curved path will continue in the frame member 28 and therefore the closed wall panel 27 will become affixed to the wall plate 25 with a fastener of exceptional structural characteristics and strength.

It may now be apparent that the distance between point C of the deflction means 12 and point B located at the outlet opening 20 of the slot 18 is the factor which determines the curvature of the arcuately deflected shank 15 of the nail 14. In many instances it may be desirable to fabricate the apparatus 10 so that the distance between points B and C thereof are fixed. In such a case all nails driven through such a fixed apparatus will emerge therefrom with the same arcuate configuration.

In other instances, it may be desirable to fabricate the apparatus so that the distance between points B and C may be adjusted to alter the arcuate curvature of nails driven therethrough.

Figure 4:
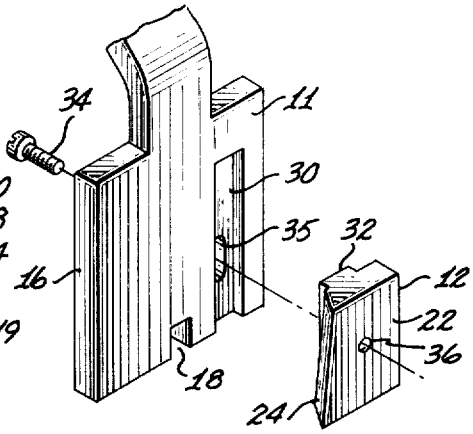
FIG. 4 is an exploded isometric view of a fragementary portion of the apparatus of FIG. 1.
Figure 5:
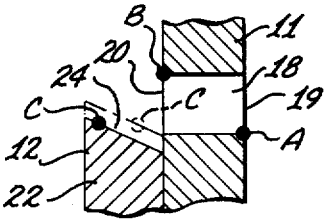
FIG. 5 is a sectional view similar to FIG. 2 and illustrating an adjustable feature of the present invention.

The preferred method of adjusting the distance between points B and C is to provide a keyway 30 in the outlet side of the flat plate 16 in which a key 32 formed on the deflection block 22 is slidably movable. The keyway 30 and key 32 supportingly guide the sliding movements of the block 22 relative to the flat plate 16. As shown in FIG. 4, the inclined surface of the block 22 is angularly disposed with respect to the key 32 so that sliding the block 22 relative to the flat plate 16 will alter the position of point C relative to point B. The block 22 may be secured in the desired position by a suitable screw 34 which passes through an elongated aperture 35 in the flat plate 16 and threadingly engages an aperture 36 provided in the block 22. The results of moving the deflection block 22 relative to the flat plate 16 are shown in FIG. 5.

Figure 6:
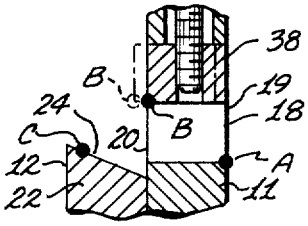
FIG. 6 is a sectional view similar to FIG. 2 and illustrating an alternate method of adjusting the apparatus of the present invention.

It will be noted that the same results of changing the distance between points B and C can be achieved by moving point B relative to point C. As shown in FIG. 6, this can be achieved by providing a sliding block 38 in the flat plate 16 which serves as one of the side walls of the slot 18.

The nail 14 shown in FIG. 2 is illustrated in the partially driven stage and it may be apparent that further movement of the nail 14 will bring the head 40 thereof into engagement with the inlet side of the flat plate 16. This condition of course, will prevent the nail from being completely driven into the workpiece, and therefore, the apparatus 10 must be disengaged from the shank of the nail 14.

During driving of the nail 14 into the slot 18 and the resulting deflection thereof, the shank 15 of the nail 14 becomes relatively tightly wedged therein. Although it is physically possible to pull the apparatus 10 laterally with respct to the shank 15 of the nail and thereby remove the apparatus 10 therefrom, such pulling would become very tedious during prolonged usage of the apparatus.

Figure 3:
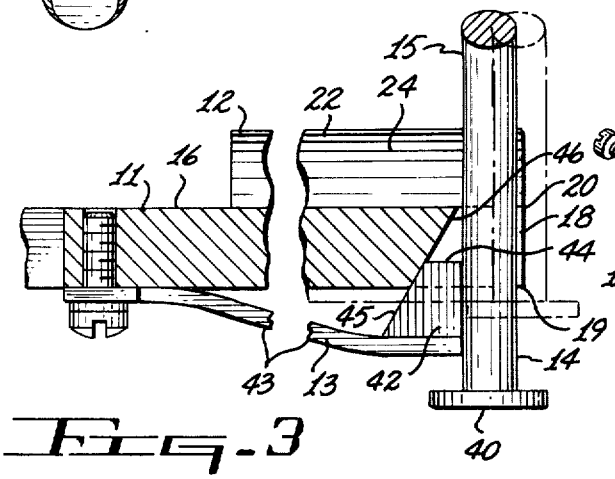
FIG. 3 is an enlarged sectional view taken on the line 3—3 of FIG. 1.

Threfore, the disengaging means 13 is provided for automatically disengaging the apparatus 10 from the shank 15 of the arcuately deflected nail 14. As seen best in FIGS. 1 and 3, the automatic disengaging means 13 includes a wedge member 42 suitably affixed to the inlet side of the flat plate 16 by a resilient strap 43. The wedge member 42 is disposed so that in its normal position, the leading edge 44 thereof is located just inside the inlet opening 19 of the slot 18 with an inclined surface 45 of the wedge member 42 in engagement with an inclined surface 46 provided in the bottom of the slot 18. To actuate the disengaging means 13, the head 40 of the nail 14 moves into engagement therewith during normal driving of the nail. The head of the nail will push the wedge member 42 into the slot 18 with the result of moving the flat plate 16 laterally with respect to the shank 15 of the nail. Thus, the slot 18 will move from around the nail and the nail can then be completely driven into the workpiece in the conventional manner. The positions of the wedge member 42, nail 14, and flat plate 16 during the disengaging operations are shown in FIG. 3 wherein the predisengaging positions are shown in solid lines and the disengaged positions are shown in dashed lines.

It should be noted that in the event that headless nails are used, alternatives to the above described disengaging means 13 may be employed. For example, the headless nail (not shown) could be driven completely, or at least partially, through the slot 18, or the apparatus 10 could be lifted axially off of the nail.

Figure 7:
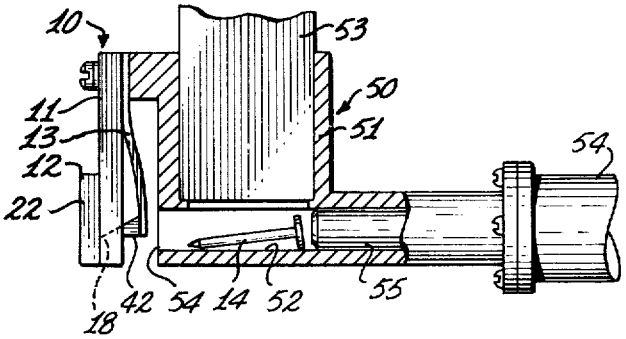
FIG. 7 is a side elevation of the apparatus of the present invention with that apparatus being mounted on a typical power nailing device.
Figure 8:
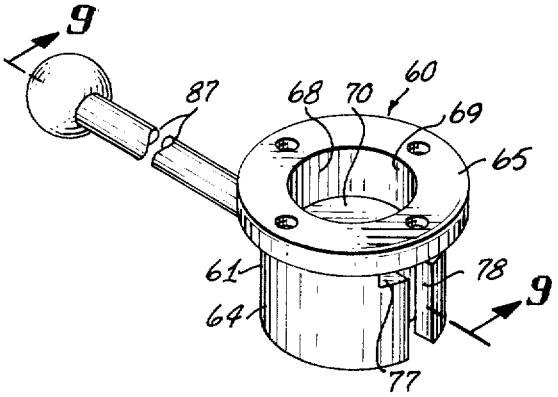
FIG. 8 is an isometric view of a second embodiment of the present invention.
Figure 10:
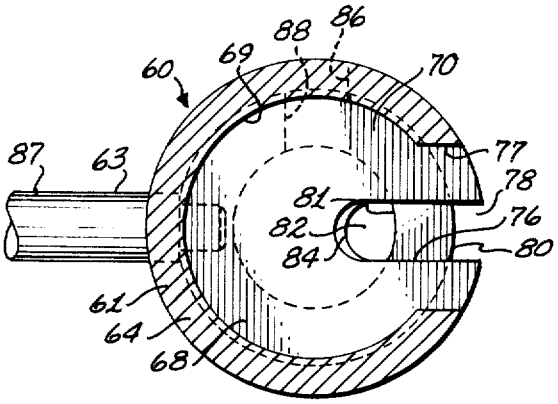
FIG. 10 is a sectional view taken on the line 10—10 of FIG. 9.

The apparatus 10 as previously described, is ideally suited for manual use and may be provided with a suitable handle 48 as shown in FIG. 1, or may be coupled to a suitable power nailing device such as the typical mechanism shown in FIG. 7 which is indicated generally therein by the reference numeral 50. Such a power nailing device may take the form of a suitable housing 51 having a feed tube 52 into which the nails 14 are sequentially deposited from a conventional magazine 53, or other suitable source of supply. The apparatus 10 of the present invention is mounted on the housing 51 adjacent the discharge end 54 of the feed tube 52 so that the slot 18 of the apparatus 10 is substantially in alignment with the feed tube 52. A suitable power means 54, which may be hydraulically, pneumatically, or electrically operated, is mounted at the opposite end of the feed tube 52. The power means 54 will move a plunger 55 down the feed tube 52 into engagement with the nail 15 and push that nail into the slot 18 of the apparatus 10.

Reference is now made to FIGS. 8 through 12 of the drawings wherein a second embodiment of the apparatus for deflecting a nail into an arcuate path is shown and which is indicated generally by the reference numeral 60.

As in the previously described apparatus 10, this apparatus 60 includes a guide means or body 61, a deflection means 62 and a disengaging means 63.

The guide body 61 of this embodiment is a cylindrical housing 64 having a flange 65 for attachment to a suitable nail supplying and power nailing device 66. It should be understood that attachment to such a power nailing device 66 is optional as the apparatus 60 could alternately be provided with a suitable handle (not shown) for manual use. The cylindrical housing 64 has a bore 68 formed in the upper end thereof with that bore 68 having an endless side wall 69 and a bottom surface 70. The opposite or bottom end of the cylindrical housing 64 has an annular channel 72 extending axially upwardly thereinto so that the housing 64 is provided with an axially extending cylindrical boss 73 inwardly disposed with respect to the annular channel 72, and an axially extending cylindrical lip or skirt 74 which is outwardly disposed with respect to the annular channel 72. The boss 73, annular channel 72, and the skirt 74 are coaxial with respect to each other.

A U-shaped slot 76 is formed in the bottom surface 70 of the bore 68 with that slot 76 extending axially downwardly through the lower end of the housing 64, and that slot 76 extends radially from the boss 73 through the annular channel 72 and through the skirt 74 so as to have a laterally disposed opening. The endless wall 69 of the bore 68 is provided with an arcuate slot 77 therein which is transverse to the radially extending laterally opening slot 76 and in communication therewith. As seen best in FIG. 8, the slots 76 and 77 form a T-shaped opening 78 in the side of the housing 64.

An annular sleeve 80 is mounted, as will hereinafter be described in detail, within the annular channel 72 so that the innermost end of the radially extending slot 76 cooperates with the inner wall or surface 81 of the sleeve 80 to form a passage 82 through the housing 64.

Figure 9:
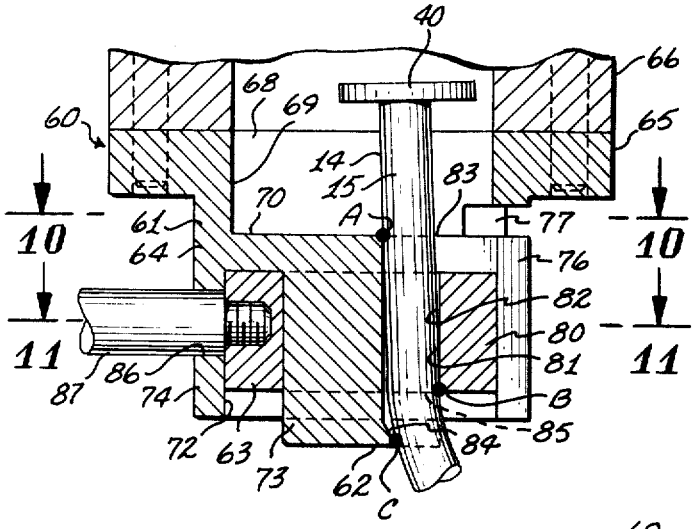
FIG. 9 is an enlarged sectional view taken on the line 9—9 of FIG. 8.

As best seen in FIG. 9, the nail 14 is fed into the bore 68 of the housing 64 with the shank 15 of the nail extending into the passage 82. When the nail 14 is driven downwardly in the passage 82, the shank 15 of the nail will move into engagement with an inclined plane surface 84 which projects over the passage 82. Upon engaging the inclined plane surface 84, which serves as the deflection means 62, the nail will be moved to the cocked position, and thus become angularly oriented within the passage 82. As previously described, this cocking of the nail 14 will move the shank 15 thereof into engagement with point A located at the inlet opening 83 of the passage 82, and the diametrically opposed side of the shank 15 will move into engagement with point B located at the outlet opening 85 of the passage 82. It will be noted that point A is provided by the bottom surface of the radially extending slot 76 and point B is provided by the inner surface 81 of the sleeve 80. These points A and B serve as support points against which the shank 15 of the nail 14 bear during deflection thereof as previously described, and the third required point, that is, the deflection point C, is provided on the inclined surface 84 of the deflection means 62.

Figure 12:
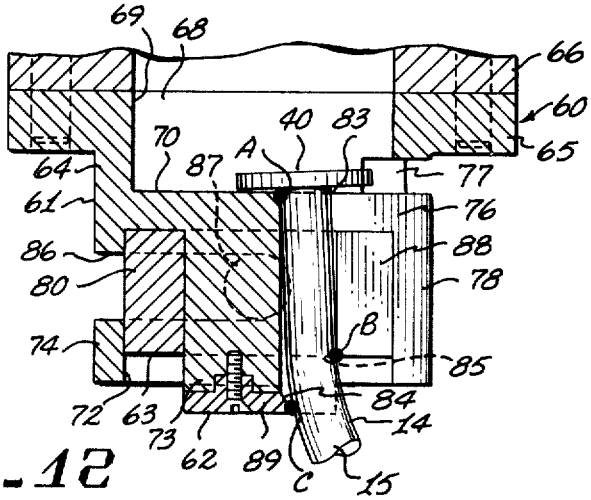
FIG. 12 is a sectional view similar to FIG. 9 and illustrating an operational position of the apparatus of the present invention.

It will be noted that the distance between points B and C is fixed in the apparatus 60 as shown in FIG. 9, and therefore, the nails driven therein will all be deflected to have the same arcuate curvature. However, it should be apparent that adjustments in the distance between these points B and C can easily be made. For example, the sleeve 80 could be replaced with another sleeve (not shown) having a smaller or larger longitudinal dimension, which of course, would move point B relative to point C. Another method of accomplishing this same objective would be to provide the inclined plane surface 84 on a movable block 89 mounted similar to the previously described block 22, and as shown in FIG. 12.

Figure 11:
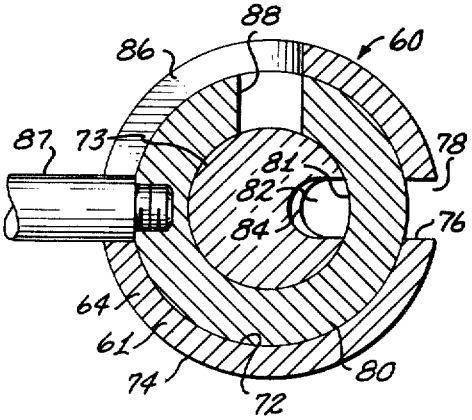
FIG. 11 is a sectional view taken on the line 11—11 of FIG. 9.

As seen best in FIG. 11, a slot 86 is formed in the skirt 74 through which a suitable handle 87 extends. The handle 87 is threadingly attached at its inner end to the sleve 80 and is employed to move that sleeve relative to the boss 73 through approximately 90°of rotation about the longitudinal axis of the cylindrical housing 64. Such rotation will move a longitudinally extending opening 88 provided in the sleeve 80 into alignment with the radially extending U-shaped slot 76 formed in the housing 64, and thus, this mechanism may be seen to form the disengaging means 63 of the apparatus 60. As shown in FIG. 12, when the nail 15 is driven so that its head 40 is proximate the bottom surface 70 of the bore 68, and the sleeve 80 has been rotated as described above, the U-shaped slot 76 is open and the apparatus 60 may be moved laterally with respect to the shank 15 of the nail 14, and thus, the nail will pass out of the T-shaped opening in the side of the housing 64.

It should be obvious from the foregoing that either of the previously described apparatuses 10 or 60 of the present invention can be set to deflect the shank of a nail through approximately 180° so that the pointed end of the nail will emerge from the surface of the workpiece adjacent the head of the nail. In this manner, the pointed end of the nail could be clinched, i.e., bent over into engagement with the surface of the workpiece, with the result that a nail so clinched will have greatly increased holding power. In the case of headless nails, both ends of the nail can be clinched in the above described manner.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An apparatus for deflecting a nail into an arcuate path and directing the arcuately configured nail into a workpiece, said apparatus comprising:

a. a guide plate for placement adjacent the workpiece, said guide plate having a slot formed to extend inwardly from one edge thereof and extend between the planar surfaces of said guide plate, the slot of said guide plate adapted to receive and supportingly guide movements of the nail from the inlet to the outlet thereof; and b. a deflection block mounted on said guide plate adjacent the outlet of the slot of said guide plate, said deflection plate having an inclined surface which projects therefrom at least part way over the outlet of the slot of said guide plate with the inclined surface of said deflection block spaced a predetermined distance from the outlet of the slot of said guide plate so that when the shank of a nail emerges from the outlet of the slot of the guide plate that shank will engage the inclined surface of said deflection block and be deflected thereby into an arcuate configuration of predetermined curvature.

2. An apparatus as claimed in claim 1 wherein the distance between the outlet of the slot of said guide plate and the inclined surface of said deflection block is adjustable to alter the arcuate curvature imparted to the shank of the nail when the nail is deflected by the inclined surface of said deflection block.

3. An apparatus as claimed in claim 1 wherein said deflection block is movably mounted on said guide plate for changing the distance between the outlet of the slot of said guide plate and the inclined surface of said deflection plate.

4. An apparatus as claimed in claim 1 further comprising disengaging means on said guide plate adjacent the slot thereof for disengaging said guide plate from the shank of the nail when the nail is positioned within the slot of said guide plate.

5. An apparatus as claimed in claim 1 further including disengaging means, said disengaging means comprising:

a. an inclined surface formed in the bottom of the slot of said guide plate; and b. a wedge member mounted adjacent the inlet of the slot of said guide plate, said wedge member movable into the slot of said guide plate upon engagement thereof by the head of the nail when the nail is moved through the slot toward the workpiece, said wedge member slidably movable along said inclined surface to move said guide plate laterally with respect to the shank of the nail to disengage said guide plate therefrom when the shank of the nail is positioned in the slot of said guide plate.

6. An apparatus for deflecting a nail into an arcuate path and directing the arcuately configured nail into a workpiece, said apparatus comprising:

a. a guide housing having a boss in which a laterally opening slot is formed with that slot extending between the opposite ends of the boss of said guide housing to provide that slot with an inlet opening and an outlet opening, said guide housing adapted for placement of the outlet opening thereof adjacent a workpiece;

b. means adjacent the boss of said guide housing to close the lateral opening of the slot formed in the boss of said guide housing to adapt that slot for receiving and supportingly guiding the movements of a nail from the inlet opening to the outlet opening thereof; and c. deflection means on said guide housing adjacent the outlet opening of the slot formed in the boss thereof, said deflection means projecting at least part way over the outlet opening of the slot of the boss and spaced a predetermined distance therefrom so that when the shank of a nail emerges from the outlet opening of the slot of said boss, that shank will engage said deflection means and will be deflected thereby into an arcuate configuration of predetermined curvature.

7. An apparatus as claimed in claim 6 wherein the distance between the outlet opening of the slot of the boss of said guide housing and said deflection means is adjustable to alter the arcuate curvature imparted to the shank of the nail when the nail is deflected by said deflection means.

8. An apparatus as claimed in claim 6 wherein said deflection means includes a deflection block having an inclined surface thereon, said deflection block being movably mounted on the boss of said guide housing adjacent the outlet opening of the slot formed therein to adjust the distance between the inclined surface of said deflection block and the outlet opening of the slot of the boss of said guide housing.

9. An apparatus as claimed in claim 6 wherein said means adjacent the boss of said guide housing to close the lateral opening of the slot formed in the boss of said guide housing is movable relative to the boss of said guide housing to open the lateral opening of the slot of the boss of said guide housing whereby said guide housing may be moved laterally from the shank of the nail when the nail is positioned within the slot of the boss of said guide housing.

* * * * *